US005899784A

United States Patent [19]

Tri et al.

[11] Patent Number: 5,899,784

[45] Date of Patent: May 4, 1999

[54] NATURAL WOOD FABRIC

[76] Inventors: Jimmy Tri; Jinna Tri, both of 1527 Holly Oak Dr., West Covina, Calif. 91791

[21] Appl. No.: 08/966,632

[22] Filed: Nov. 10, 1997

[51] Int. Cl.[6] ..... B32B 21/02; B32B 9/00

[52] U.S. Cl. ..... 442/295; 442/152; 139/420 R

[58] Field of Search ..... 442/295, 60, 152; 139/420 R; 428/137, 131

[56] References Cited

U.S. PATENT DOCUMENTS

| | | | |
|---|---|---|---|
| 39,556 | 8/1863 | Dunkin . | |
| 123,810 | 2/1872 | Cone . | |
| 130,171 | 8/1872 | Woodley . | |
| 4,874,465 | 10/1989 | Cochrane et al. | 162/111 |
| 4,902,564 | 2/1990 | Israel et al. | 428/284 |
| 5,026,587 | 6/1991 | Austin et al. | 428/138 X |
| 5,459,912 | 10/1995 | Oathout et al. | 428/137 X |
| 5,645,916 | 7/1997 | Oathout et al. | 428/137 X |

*Primary Examiner*—Daniel Zirker
*Attorney, Agent, or Firm*—Chan Law Group

[57] ABSTRACT

A fabric consisting essentially of a mixture of white pine wood fibers and fibers of another natural material derived from plant materials. The fibers of white pine wood comprise at least 20% of the mixture, and the other material is preferably cotton.

14 Claims, No Drawings

NATURAL WOOD FABRIC

BACKGROUND OF THE INVENTION

1. Field of the Invention

The present invention relates generally to fabrics, cloth and the like, and more particularly to a novel fabric consisting essentially of fibers derived from plant material, and still more particularly to fabrics consisting of fibers derived from white pine mixed with fibers derived from other plant materials in a proportionate mix where the white pine fiber content is no less than 20% of the mix and the fiber content derived from other plant materials is no more than 80%.

2. Description of the Related Art

Fabrics containing fibers derived from plant materials are well-known. One type of process for producing such yarns is the production of vicose rayon, patterned after the Chardonnet process in which cellulose is first converted to a soluble compound. In this process, developed in 1892 by three British chemists, the cellulose is dissolved to form a viscous liquid known as "vicose". Typically, the process entails soaking raw material in a caustic solution, shredding alkali cellulose into crumbs and mixing the shredded cellulose with a substance such as carbon disulfide to form the viscose, aging the viscose, spinning filament yarn (e.g., by a centrifugal method), winding the spun yarn into cakes or cutting the filaments into short fibers, cleaning the yarn, removing moisture from the yarn and drying it, and then packaging the yarn for shipments to processors, such as weavers, spinners or knitters.

The raw materials for viscose rayon can be cotton linters, the short fibers adhering to the cotton seed, or wood pulp derived from a variety of timber species, including redwood (U.S. Pat. No. 123,810 to Cone), cedar (U.S. Pat. No. 130,171 to Woodley), and southern yellow pine (U.S. Pat. No. 4,874,465 to Cochrane et al. ). In addition, other plant materials have been used to produce yarn for the textile industry, as exemplified by U.S. Pat. No. 39,556 to Dunkin, which teaches the manufacture of textile fabrics using of a mixture of "down", obtained from the inner portions of milkwood seeds, and cotton.

It is also well known to mix fibers derived from plant materials with fibers produced from synthetic materials. U.S. Pat. No. 4,902,564 to Israel et al. teaches the use of a highly absorbent fabric composed of wood pulp and fibers composed of synthetic resins. The wood pulp content of the web material produced in accordance with the process of Cochrane is in the range of from about 50 weight percent to about 75 weight percent. Yet, Cochrane et al. teach that, while the higher levels of wood pulp impart increased absorbency, they also usually result in loss of abrasion resistance and tensile strength.

Against this background, the inventor has discovered a new, highly absorbent, material exhibiting significantly higher absorbency and strength when compared with rayon and similar materials as well as cotton, the new material being comprised of a mixture of fibers derived from white pine wood and other natural, non-synthetic materials.

OBJECTS OF THE PRESENT INVENTION

It is therefore a principal object of the present invention to provide a new, all natural cloth or fabric which exhibits superior strength and moisture absorbency characteristics over all other known cloth or fabric materials.

Another object of the invention is to provide a new cloth or fabric which is capable of cleaning and/or absorbing grease from surfaces and then washing clean using just plain water.

Still another object of the invention is to provide a new cloth or fabric which will clean and/or absorb grease from surfaces and then wash clean without the use of detergent.

These and other objects of the invention are achieved by the provision of a fabric or cloth made from a mixture of organic material fibers, including white pine wood and one other material from the group including cotton and hemp.

The objects and features of the present invention, which are believed to be novel, are set forth with particularity in the appended claims. The present invention, together with further objects and advantages, may best be understood by reference to the following detaiied description.

DETAILED DESCRIPTION OF THE INVENTION

The following description is provided to enable any person skilled in the art to make and use the invention and, with reference to the drawings, sets forth the best mode contemplated by the inventor of carrying out this invention.

Various modifications, however, will remain readily apparent to those skilled in the art, since the generic principles of the present invention have been defined herein specifically to provide an improved fabric made entirely of plant materials, and which exhibits high absorbency, abrasion resistance, and tensile strength.

The process for making the fabric of the present invention entails steps which are substantially similar to current conventional processes for producing vicose rayon, with the exception that the wood raw material used in the process of the present invention is a white pine timber. Before the spinning step, the wood pulp can be mixed with cotton fibers. A preferred mixture is one in which the different fibers exist in a proportionate ratio of 20%–100% white pine fibers and 80%–0% cotton fibers.

Vicose rayon is a cellulose fiber similar to cotton in its cellulosic structure. The fibers produced by the present invention have high strength, especially when wet, and good dimensional stabillity and firmness. In addition, the fibers produced by the process of the invention are highly absorbent, whether or not combined with cotton fibers.

The fibers which result from the process of the present invention can be spun or woven into a fabric or produced as a non-woven mat, either for use in that form or for transport to another location for incorporation into other products.

The fabric made in accordance with the invention will be used in the manufacture of clothing, curtains, upholsteries, carpets and other floor coverings, industrial strength towels, and medical fabrics.

The fabric or cloth of the invention is suited for cleaning and/or absorbing grease from surfaces and then washing clean using just plain water. The new cloth or fabric of the invention will clean and/or absorb grease from surfaces and then wash clean without the use of detergent.

The fabric or cloth of the invention will remove all greasy stains without detergent or any other chemical agents, and then rinse clean in water. For use as a cleaning cloth, first dampen with water, then rinse clean with cold or warm water and air dry before storing for later use.

Those skilled in the art will appreciate that various adoptions and modifications of the just-described preferred embodiments can be configured without departing from the scope and spirit of the invention. Therefore, it is to be understood that, within the scope of the appended claims, the invention may be practiced other than as specifically described herein.

What I claim is:

1. A fabric, consisting of fibers derived from plant materials, including fibers derived from white pine.

2. The fabric of claim 1, wherein said fibers are formed as a woven fabric.

3. The fabric of claim 1, wherein said fibers are manufactured using a vicose rayon process.

4. The fabric of claim 1, wherein said white pine fibers comprise at least 20%.

5. The fabric of claim 4, wherein said white pine fibers comprise 20% to 100%.

6. The fabric of claim 1, wherein said fabric further includes cotton fibers.

7. The fabric of claim 6, wherein said fibers are in a proportionate ratio of about 20%–100% white pine and 80%–0% cotton.

8. The fabric of claim 7, wherein said white pine fibers comprise about 80% and said cotton fibers comprise about 20%.

9. The fabric of claim 1, wherein the fibers are manufactured as a terry cloth.

10. The fabric of claim 1, wherein said fibers are manufactured to form a knitted fabric.

11. An article of clothing comprising fabric consisting essentially of fibers derived from white pine and another plant material, said fibers of white pine comprising at least 20% of said fabric fibers.

12. The article of clothing of claim 11, wherein said white pine fibers make up from 20% to 100% of said fabric fibers.

13. An article of manufacture consisting essentially of fibers derived from natural plant materials, including at least 20% of fibers derived from white pine.

14. The article of manufacture of claim 13, and further including fibers of cotton, said cotton fibers rendering the article of manufacture highly absorbent .

* * * * *

UNITED STATES PATENT AND TRADEMARK OFFICE

CERTIFICATE OF CORRECTION

PATENT NO. : 5,899,784

DATED : May 4, 1999

INVENTOR(S) : Jimmy Tri; Jinna Tri

It is certified that error appears in the above-identified patent and that said Letters Patent is hereby corrected as shown below:

In claim 1, column 3, line 2, between "consisting" and "of", insert - - essentially - -.

Signed and Sealed this

Fifth Day of October, 1999

*Attest:*

*Attesting Officer*

Q. TODD DICKINSON

*Acting Commissioner of Patents and Trademarks*